US012584711B2

(12) United States Patent
Main

(10) Patent No.: US 12,584,711 B2
(45) Date of Patent: Mar. 24, 2026

(54) UNIVERSAL MOUNT SYSTEMS AND METHODS FOR TACTICAL ACCESSORIES

(71) Applicant: BlackPoint Tactical, LLC, Alpharetta, GA (US)

(72) Inventor: Adam Main, Alpharetta, CA (US)

(73) Assignee: BP Tactical, LLC, Swansboro, NC (US)

( * ) Notice: Subject to any disclaimer, the term of this patent is extended or adjusted under 35 U.S.C. 154(b) by 654 days.

(21) Appl. No.: 18/074,262

(22) Filed: Dec. 2, 2022

(65) Prior Publication Data

US 2023/0175538 A1 Jun. 8, 2023

Related U.S. Application Data

(60) Provisional application No. 63/285,728, filed on Dec. 3, 2021.

(51) Int. Cl.
*F41C 33/04* (2006.01)

(52) U.S. Cl.
CPC ..... *F41C 33/045* (2013.01)

(58) Field of Classification Search
CPC ..... A45F 2005/025; A45F 2005/027; A45F 5/02; B60R 2011/0085
See application file for complete search history.

(56) References Cited

U.S. PATENT DOCUMENTS

| | | | | |
|---|---|---|---|---|
| 8,297,562 | B1 * | 10/2012 | Yeates | A45F 5/02 248/222.51 |
| 8,544,706 | B2 * | 10/2013 | Crye | F41C 33/0236 224/198 |
| 10,030,934 | B2 * | 7/2018 | Metayer | F41C 33/048 |
| 10,883,795 | B2 * | 1/2021 | Rogers | F41C 33/0209 |
| 11,313,644 | B1 * | 4/2022 | Kirk | F41C 33/045 |
| 11,686,552 | B2 * | 6/2023 | Wortman | F41C 33/041 224/243 |
| 12,130,115 | B2 * | 10/2024 | Smith | A45F 5/02 |

* cited by examiner

*Primary Examiner* — Corey N Skurdal
(74) *Attorney, Agent, or Firm* — Eversheds Sutherland (US) LLP

(57) ABSTRACT

A universal mount system for mounting an accessory to a base in various orientations is provided. The present disclosure provides a universal mount capable of being coupled to various bases. An accessory mount is then coupled to the universal mount in one of a number of different orientations. An accessory, such as a holster, is then coupled to the accessory mount.

20 Claims, 19 Drawing Sheets

UNIVERSAL MOUNT SYSTEMS AND METHODS FOR TACTICAL ACCESSORIES

CROSS-REFERENCE TO RELATED APPLICATIONS

The disclosure claims priority to and the benefit of U.S. provisional application No. 63/285,728, filed Dec. 3, 2021, which is hereby incorporated by reference herein in its entirety.

FIELD

The disclosure generally relates to tactical accessories and more particularly relates to systems and methods for an adjustable mount for mounting other storage accessories such as holsters, magazine mounts, or other tactical accessories.

BACKGROUND

A wide variety of mounts for holsters and other attachments exist that are fixed in a set position relative to the mount. This lack of customization can render drawing from the holster or accessing various tactical accessories difficult or uncomfortable from certain positions. What is desirable is an improved mounting system and method that provides for adjustability and versatility.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Figure 1:
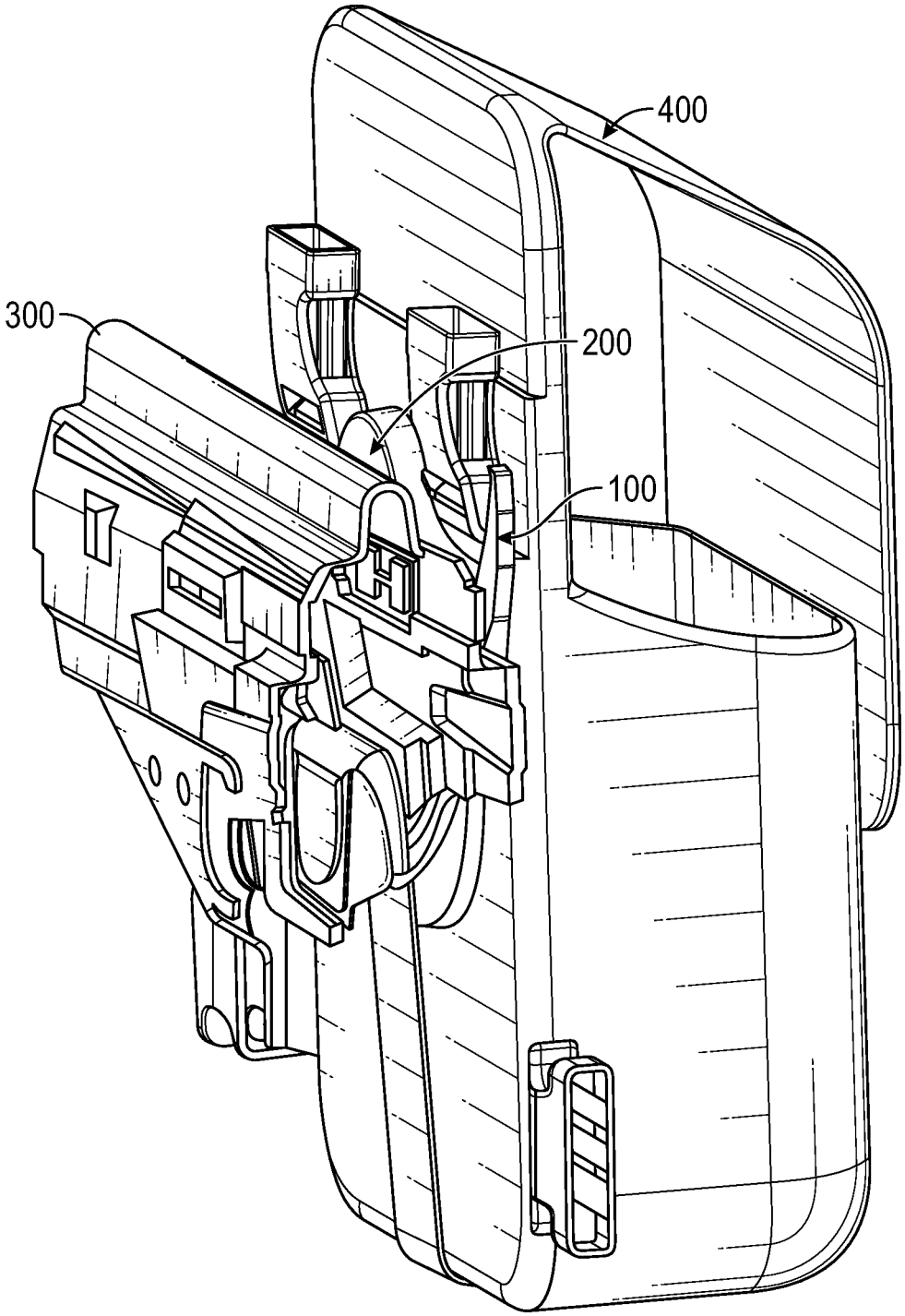
FIG. 1 is a perspective view of a universal mount system attached to an item in accordance with one or more embodiments of the disclosure.

The disclosure is directed to systems and methods for a universal mount system. Methods of manufacturing and using the universal mount system are also disclosed.

In one or more embodiments, the disclosure provides for a system for mounting an article, such as a holster to a firearm, a sheath to a combat knife, magazine band, or another accessory in various orientations along with a method to use the aforementioned system. In some instances, the system may comprise a universal mount for mounting the system to various bases, an accessory mount configured to be mounted to the universal mount in various orientations, and an accessory configured to be coupled to the accessory mount. A base could be, for example, a Bino pack, a shirt or pants, a backpack or satchel, or another base or item capable of being coupled to the universal mount. In one or more embodiments, the universal mount has one or more wings that form hook-like structures where the wings attach (e.g., hook) onto a feature of the base. For example, the wings could be inserted into a hole, hang from a protrusion, or hook into the loop of a strap of the base. In the same or other embodiments, the universal mount may include holes or apertures that are configured to have straps or other securing mechanisms of the base to further secure the universal mount to the base. One skilled in the art would recognize that the universal mount may either be removably attached to the base or permanently attached to the base.

In another embodiment, the universal mount may have a wheel-like structure comprising radially spaced channels. In a further embodiment, the channels may be radially spaced around a central bore hole. In the same or another embodiment, the accessory mount may comprise radially spaced protrusions corresponding to the radially spaced channels of the universal mount. In a further embodiment, the protrusions are radially spaced around a central hole. One skilled in the art would understand that the protrusions could instead be placed on the universal mount and the channels placed on the accessory mount. Further, one skilled in the art would understand that the universal mount may have both channels and protrusions as long as the accessory mount also has protrusions corresponding to the channels of the universal mount and channels corresponding to the protrusions of the universal mount. In one or more embodiments, the radially spaced channels form a complete circle while in other embodiments, the radially spaced channels may only form an arc. In yet other embodiments, the channels may be arranged in other shapes. For example, a square, a triangle, or another shape that allows for the accessory mount to be coupled to the universal mount in various orientations. The channels may also, in some instances, form more than one shape such as two concentric circles. In one embodiment, the number of protrusions equals the number of channels, but in another embodiment, the number of channels is greater than the number of protrusions.

In one or more embodiments, the accessory mount is coupled to the universal mount by first aligning the protrusions of the accessory mount with the channels of the universal mount so that the accessory mount is in the desired orientation. For example, horizontal, vertical, or slightly canted. In one or more embodiments, once the protrusions are aligned with the channels, the central hole and the central bore are coaxially aligned. In other or the same embodiments, the accessory mount is configured to have a screw, nut and bolt, pin, or other fastening mechanism engaged through the central hole and the central bore to secure the accessory mount to the universal mount. In such instances, either or both of the central hole and the central bore may be threaded. In another embodiment, the above mentioned fastening mechanisms may engage the central hole of the accessory mount, extend through the central bore, and securely engage with base. In such an instance, the fastening mechanism secures the accessory mount to the universal mount by pinching the universal mount between the accessory mount and the base.

In one or more embodiments, the accessory mount may comprise one or more appendages configured to engage with one or more cavities on the accessory. For example, the accessory mount may have a "T" shaped protrusion, a t-slot, configured to slide into the cavity of a holster for a firearm. Such an arrangement would allow the holster to slide on and off the accessory mount in a single direction. In the same or other embodiments, the accessory mount may further comprise hook configured to engage with an offset disposed on the accessory. In such an embodiment, the hook may be configured to experience flexure. In such an instance, as the accessory is sliding along the accessory mount after inserting the t-slot into the cavity, the accessory flexes the hook so that the accessory may slide over the hook, substantially unhindered. Once the accessory has been sufficiently slid along the accessory mount, the offset passes the hook. Once the offset passes the hook, the hook is released from its flexed position and falls into a hole on the side of the offset. In such an instance, the hook then abuts the offset in such a manner that the accessory cannot be slid in the opposite direction and is securely fastened to the accessory mount. In order to remove the accessory, a force must be applied to the hook to cause it to flex in order to disengage from the offset while simultaneously sliding the accessory in the direction opposite the direction it was slid to engage the hook with the offset. One skilled in the art would understand that the t-slot and hook may be instead located on the holster or other accessory while the cavity and offset are located on the accessory mount. In yet another embodiment, the accessory may have an identical cavity and offset pair (or t-slot and hook pair) on a second surface or any number of surfaces of the accessory to further increase the variability of mounting orientations. In another embodiment, the accessory has a t-slot and offset pair while the accessory mount has a cavity and hook pair. In yet another embodiment, the accessory has a cavity and hook pair while the accessory mount has a t-slot and offset pair.

Reference will now be made to the accompanying figures to describe the various embodiments.

FIG. 1 depicts an embodiment of the universal mount system. In some instances, the universal mount system may include a pack 400 (or other mounting item) coupled to a universal mount 100. For example, the pack 400 may comprise a Bino pack or the like. The universal mount 100 may be coupled to any suitable mounting item or surface. In some instances, the universal mount 100 may lay flat against a surface of the pack 400. That is, the universal mount 100 may be positioned against and flush with a surface of the pack 400. The universal mount 100 may be coupled to an accessory mount 200. In some instances, the accessory mount 200 may be attached to a holster 300, magazine band, or the like. In some instances, the accessory mount 200 may be moveably attached to and positioned flush against the universal mount 100.

Figure 2:
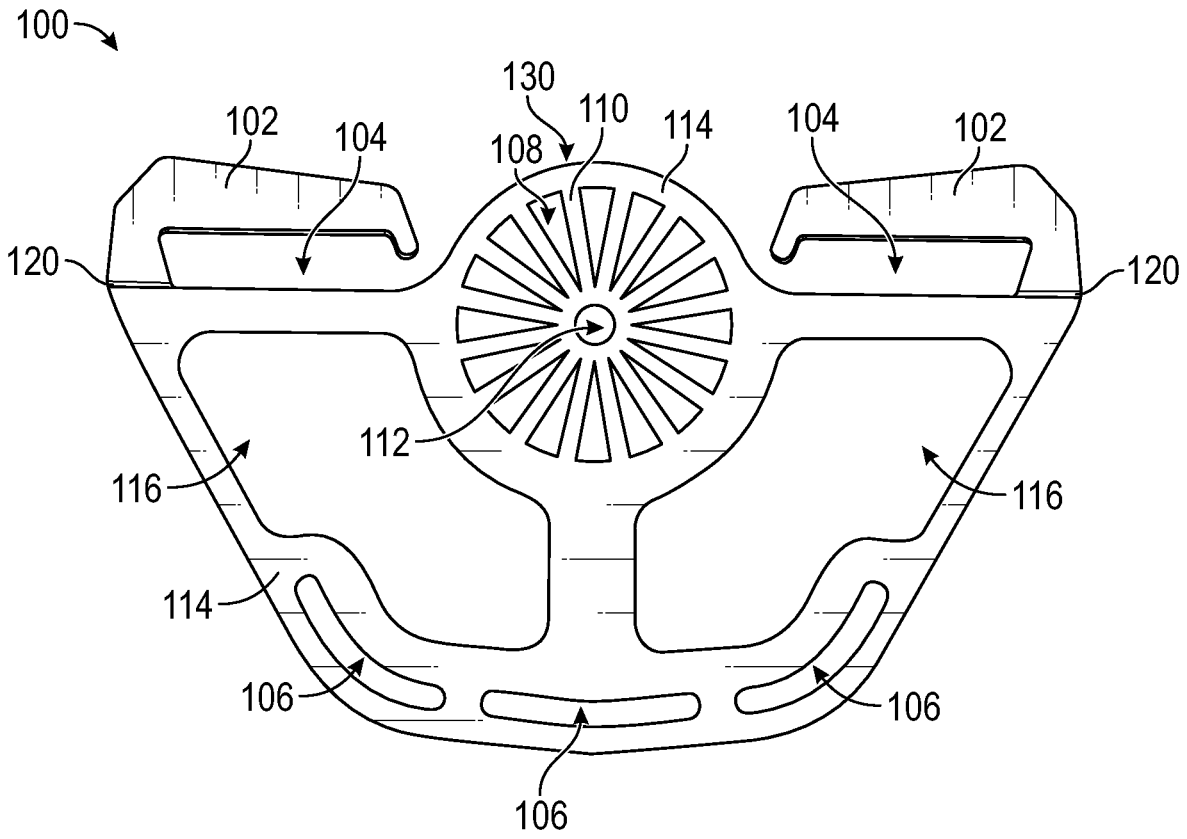
FIG. 2 is a front view of the universal mount in accordance with one or more embodiments of the disclosure.

FIG. 2 depicts an embodiment of the universal mount 100. The universal mount 100 is configured to be secured to a pack 400 and have an accessory mount 200 coupled thereon. The universal mount 100 has a frame 114 which forms wings 102 partially enclosing gaps 104 between the wings 102 and the frame 114. The universal mount 100 has apertures 106 in the frame 114 for mounting straps or another securing mechanism therethrough. The universal mount may have further holes 116 disposed in the frame 114. The universal mount 100 has a wheel mechanism 130 formed by the frame 114. The wheel mechanism 130 of the universal mount 100 has a number of radially disposed spokes 110 which form radially spaced channels 108 around a central point. The central point is a bore 112.

Figure 3:
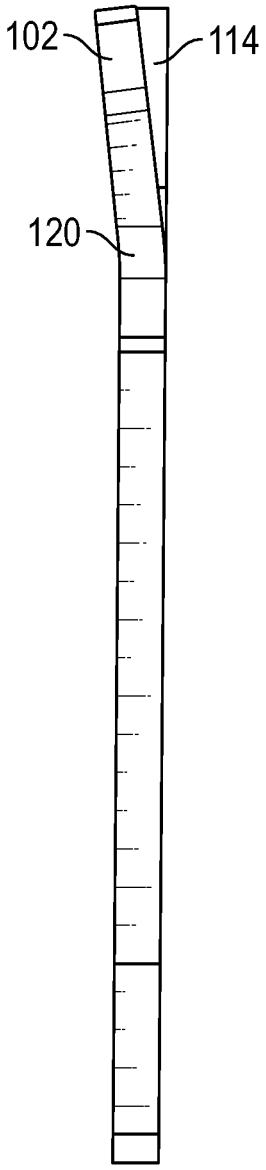
FIG. 3 is a side view of the universal mount in accordance with one or more embodiments of the disclosure.
Figure 4:
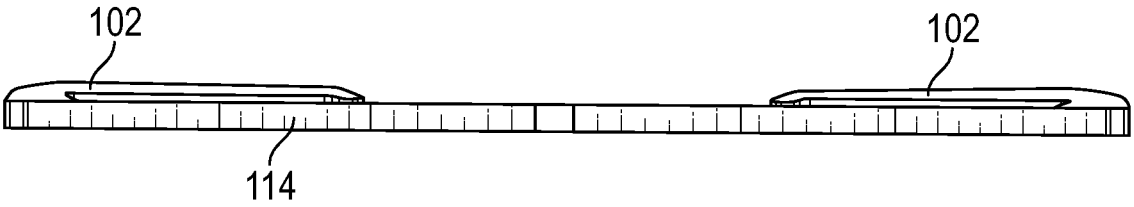
FIG. 4 is a bottom view of the universal mount in accordance with one or more embodiments of the disclosure.
Figure 14A:
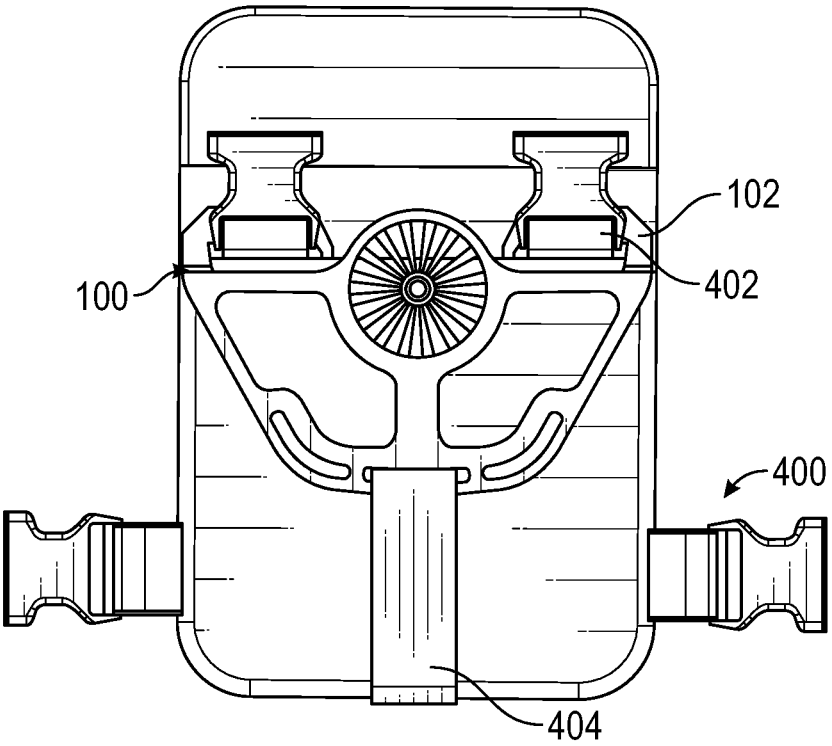
FIG. 14A is a front view of a universal mount operably coupled to a pack in accordance with one or more embodiments of the disclosure.

In some embodiments, the wings 102 of the universal mount 100 partially enclose gaps 104. As shown in FIG. 3, the wings 102 may be in a different plane than the frame 114 of the universal mount 100, separated by an angled piece 120 at the base of the wings. Together, the wing 102 and spaces 104 form a mounting mechanism to secure the universal mount 100 to a loop, strap, or other securing mechanism of a pack 400 (or other mounting item). As shown in FIG. 14*a*, the wings 102 may be inserted through straps 402 of the pack 400 to secure the wings 102, and thereby the universal mount 100, to the pack. Other mounting mechanisms and securing mechanisms are able to be used to secure a universal mount 100 to a pack 400 including, but not limited to, hook and loop fasteners, zip fasteners, snap and fit fasteners, and any other fastening method or mechanism suitable to firmly secure the universal mount.

Figure 14B:
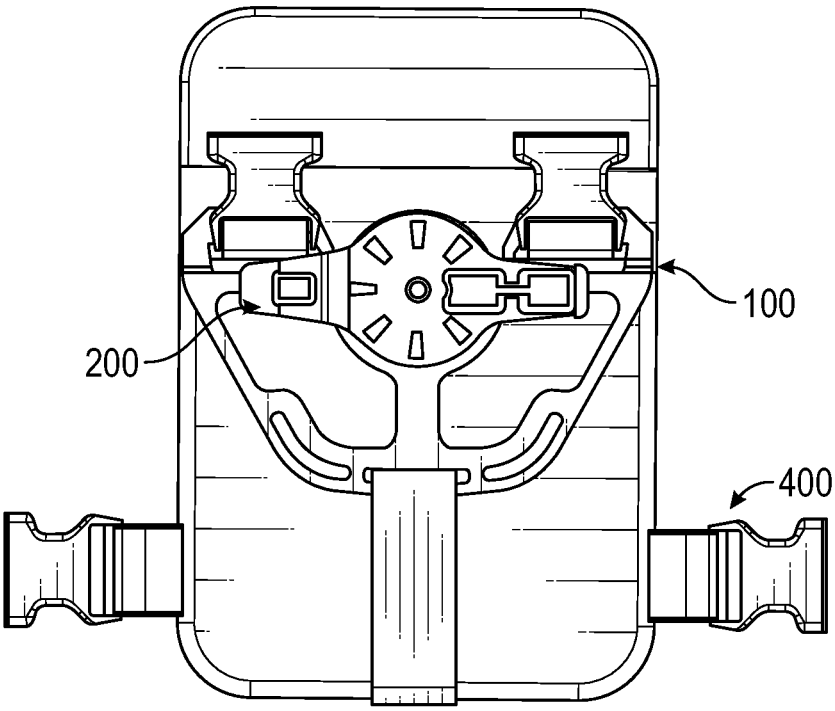
FIG. 14B is a front view of a universal mount operably coupled to a pack, with an accessory mount coupled thereon in accordance with one or more embodiments of the disclosure.

In some embodiments, as shown by FIGS. 2, and 14*a* and 14*b*, apertures 106 are disposed in the frame 114. In one embodiment, there are three apertures 106 on the frame 114 disposed opposite the wheel mechanism 130 and the wings 102. The apertures 106 may be thin and follow the curvature of the frame 114. A strap 404 may be inserted through these apertures 106 to secure the frame 114 and thereby the universal mount 100 to the pack 400. The apertures 106 may also be secured by hook and loop, snap fit, zipper or any other suitable attachment system. Any suitable size, shape, spacing, and number of apertures 106 for securing the frame 114 to the pack 400 may be used.

Figure 10:
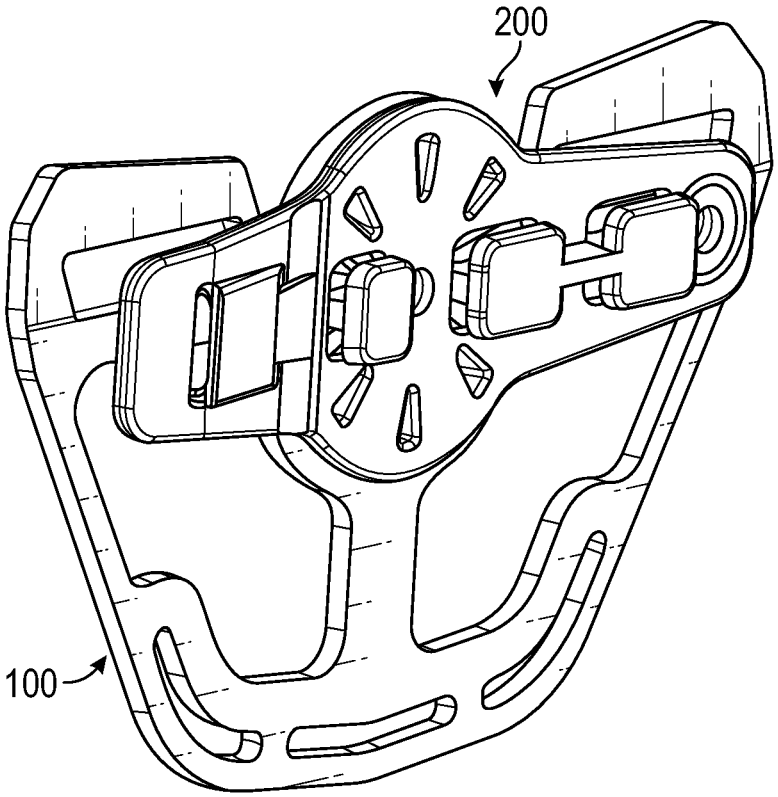
FIG. 10 is a front view of a universal mount operably coupled to an accessory mount in accordance with one or more embodiments of the disclosure.
Figure 11:
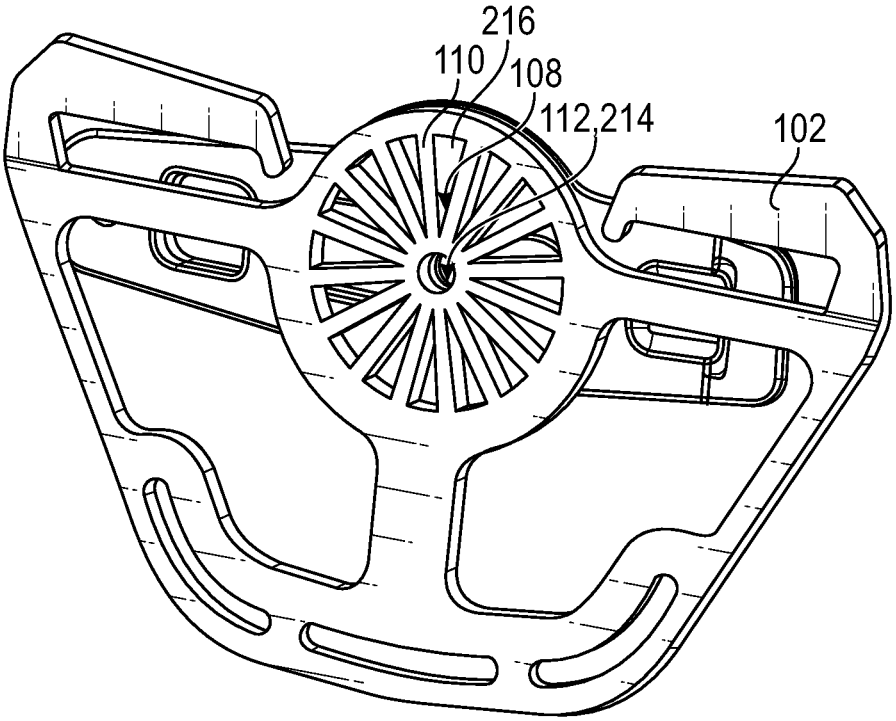
FIG. 11 is a rear view of a universal mount operably coupled to an accessory mount in accordance with one or more embodiments of the disclosure.
Figure 19:
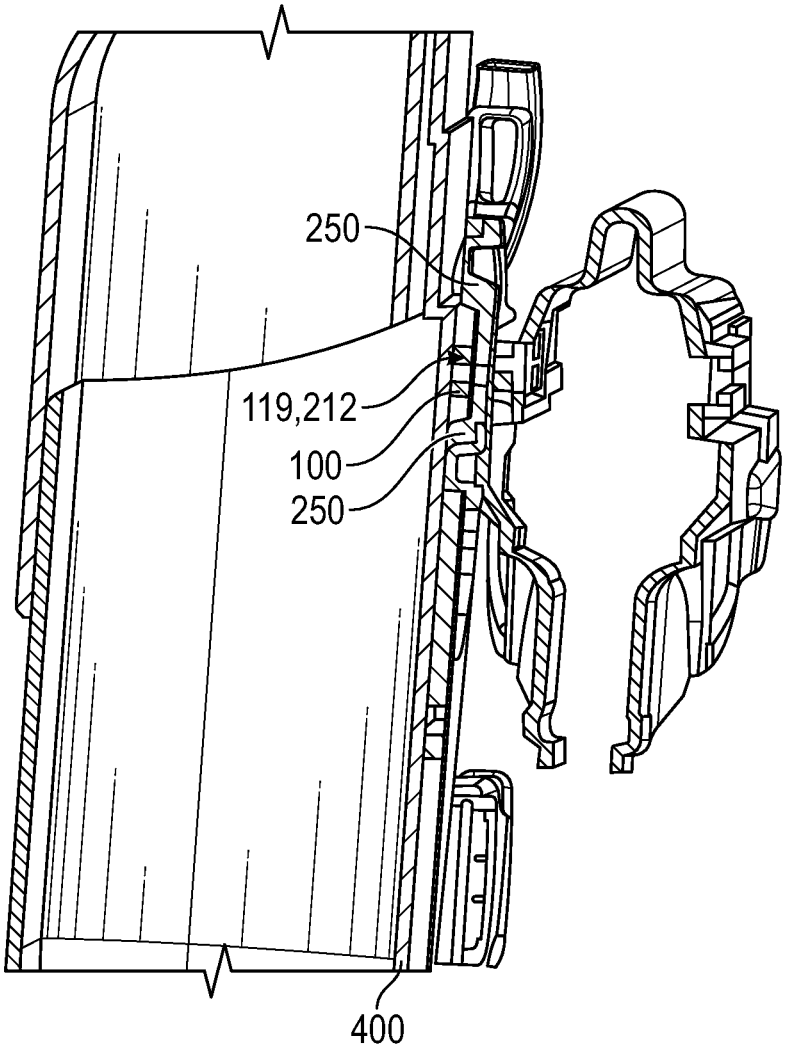
FIG. 19 is a section view of a universal mount system attached to an item in accordance with one or more embodiments of the disclosure.
Figure 20:
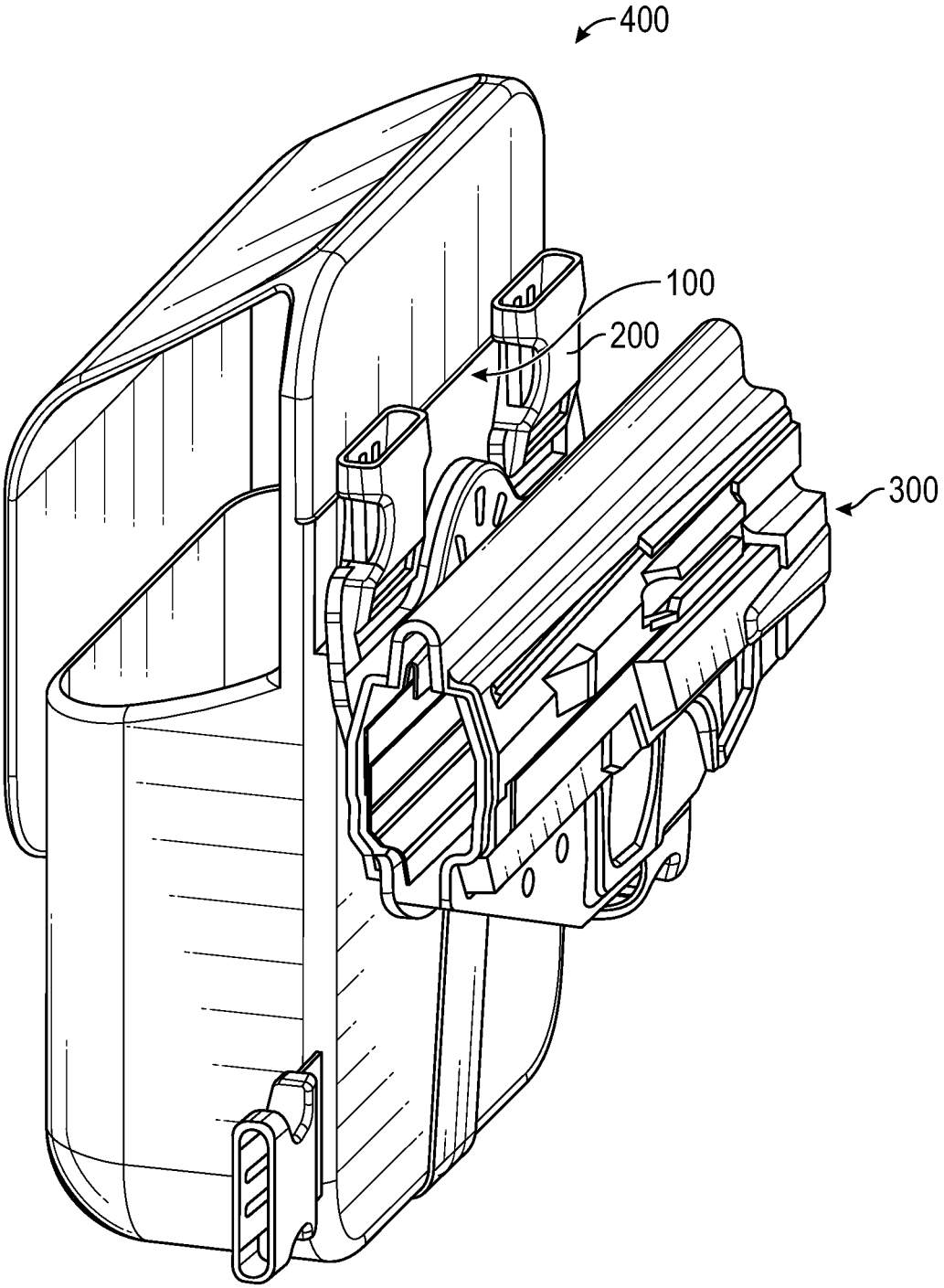
FIG. 20 is a perspective view of a universal mount system attached to an item in accordance with one or more embodiments of the disclosure.

In some embodiments, the wheel mechanism 130 is disposed within the frame 114 between the wings 102 and opposite the apertures 106. The wheel mechanism 120 can also be disposed anywhere on the universal mount 100 suitable to allow mounting of the accessory mount 200 and allow rotation of the accessory mount 200 about the universal mount 100. The wheel mechanism 130 of the universal mount 100 has a number of radially disposed spokes 110 which form radially spaced channels 108 around a central point. The central point is a bore 112. The wheel mechanism 130, as shown in FIGS. 10, 11, and 19, is configured to allow the accessory mount 200 to be mounted upon the universal mount 100.

Figure 15A:
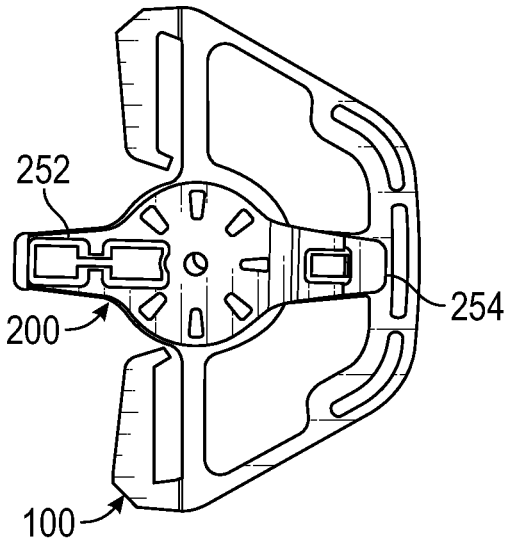
FIG. 15A is a front view of an accessory mount coupled to a universal mount in the vertical orientation in accordance with one or more embodiments of the disclosure.
Figure 15B:
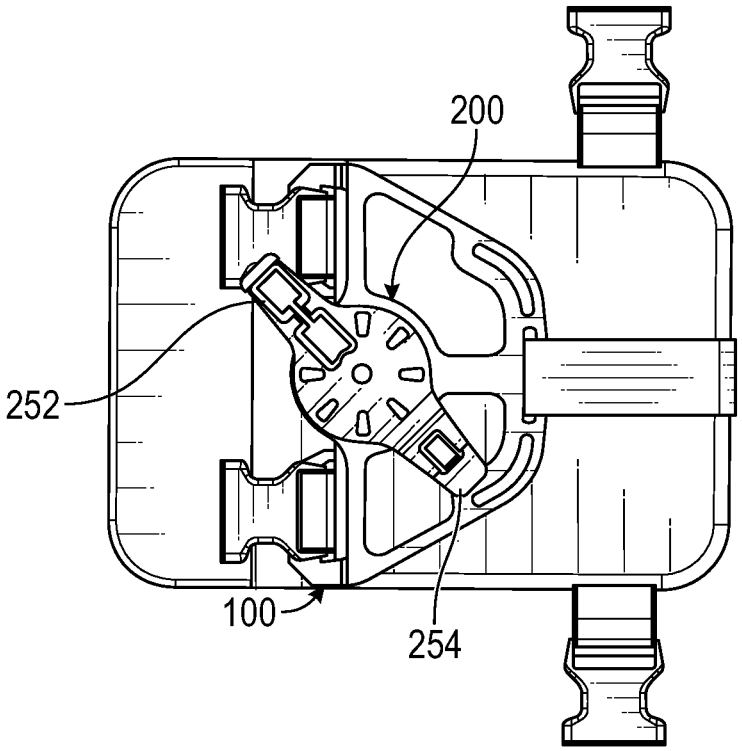
FIG. 15B is a front view of an accessory mount coupled to a universal mount in a slightly canted orientation in accordance with one or more embodiments of the disclosure.

In some embodiments, the radially disposed spokes 110 are radially disposed around a central bore 112. The radially disposed spokes 110 may vary in width to adjust the number of radially spaced channels 108. The radially disposed spokes 110 prevent rotation of the accessory mount 200 when the accessory mount 200 is flush against the universal mount 100. As depicted in FIGS. 10, 15*a*, and 15*b*, the radially disposed spokes 110 may be any shape, size, and number suitable to accept the protrusions 216 of the accessory mount in multiple configurations rotating around the central bore 112. Such configurations may include, but are not limited to, vertical, horizontal, or slightly canted manipulation.

Figure 16:
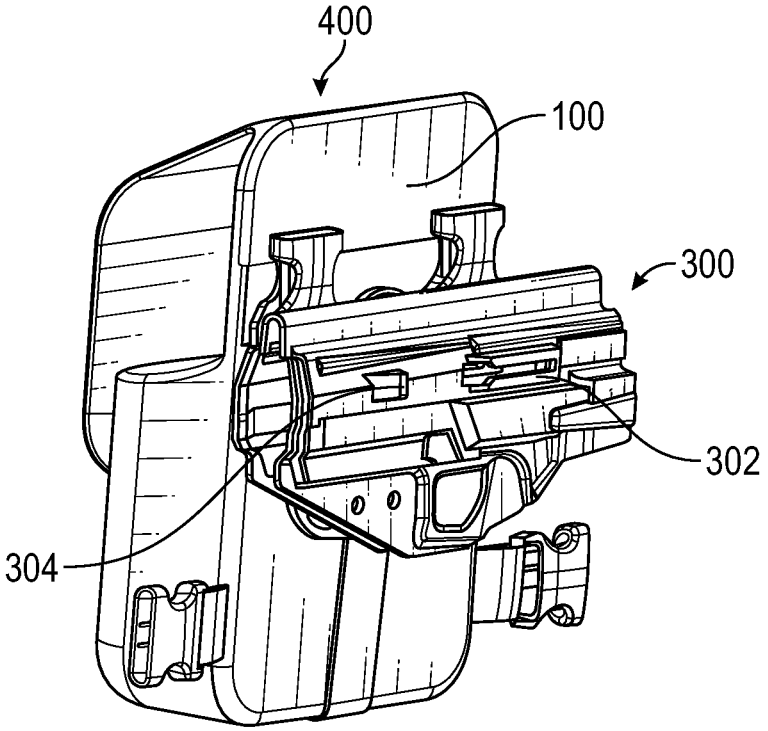
FIG. 16 is a perspective view of a universal mount system attached to an item in accordance with one or more embodiments of the disclosure.

In some embodiments, the radially spaced channels 108 are radially spaced around a central bore 112. The radially spaced channels 108 are separated by the radially disposed spokes 110. The radially spaced channels 108 allow for the protrusions 216 of the accessory mount 200 to be inserted therein, allowing multi-configuration adjustment of the accessory mount 200 in a circular direction. Based on the number and spacing of the radially spaced channels 108, moving a protrusion 216 from one radially spaced channel 108 to the next channel 108 about the central bore 112 adjusts the accessory mount 200 a set number of degrees. As depicted in FIGS. 1 and 16 radially spaced channels 108 allow for a rotation of 22.5 degrees when rotating the protrusions 216 from one radially spaced channel 108 to the next. Any degree of rotation may be used herein. This system allows the accessory mount 200 to be coupled to the universal mount 100 in multiple orientations. The desired adjustability of rotation can be configured by adjusting the spacing and number of the radially spaced channels 108. The radially spaced channels 108 may extend fully through the universal mount 100 or only partially therethrough.

In some embodiments, the central bore 112 may be in the center of the wheel mechanism 130. The central bore 112 may be of any shape and dimensions. The central bore 112 may be threaded or otherwise configured to hold a pin, screw, or other fastener. The central bore 112 may align with the hole 214 of the accessory mount 200.

In some embodiments, cutouts 116 on the frame 114 lighten the universal mount 100 and may function similarly to the apertures 106, allowing straps, ropes, ties, or other securing means to be inserted therethrough to secure the frame 114 to a pack.

Figure 5:
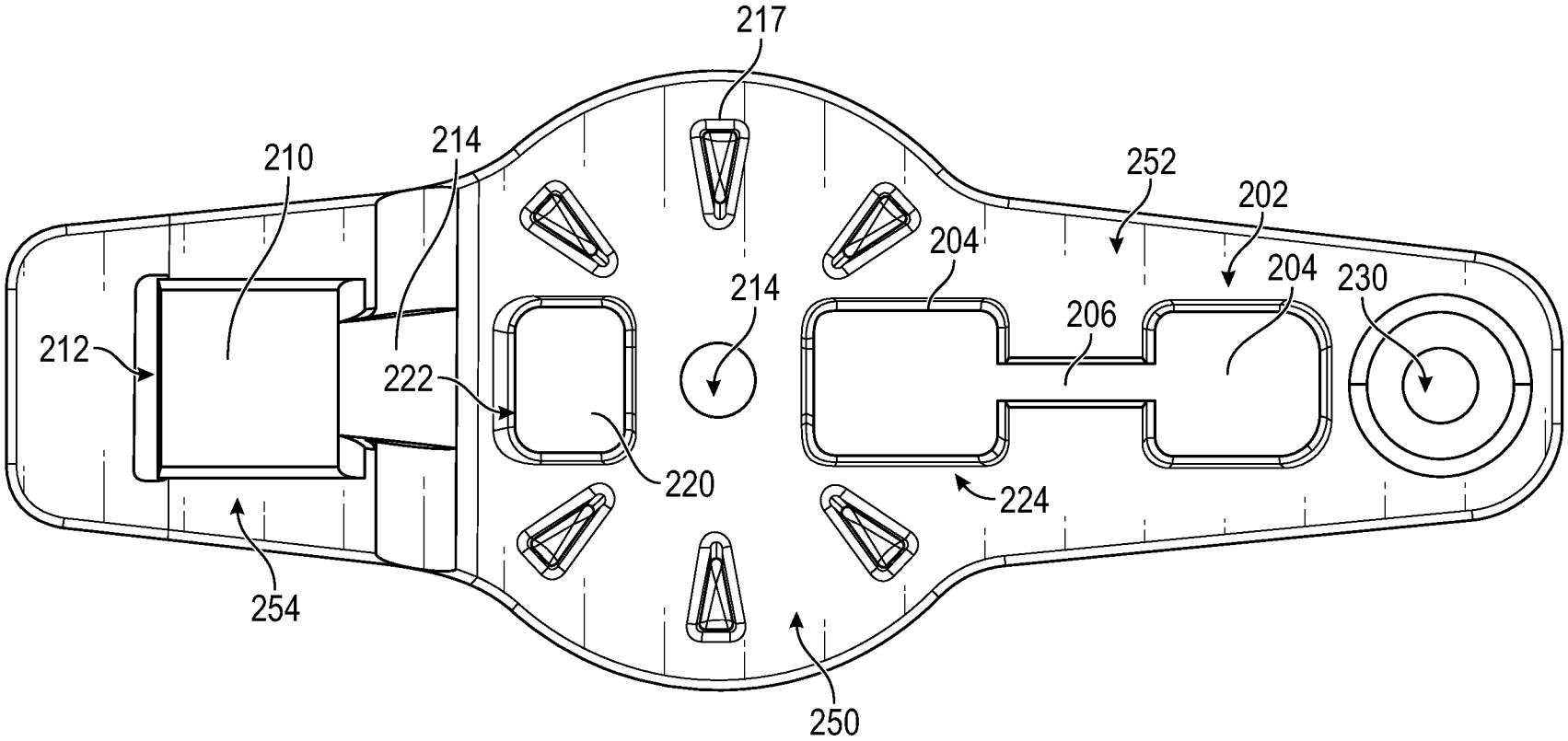
FIG. 5 is a front view of an accessory mount in accordance with one or more embodiments of the disclosure.
Figure 6:
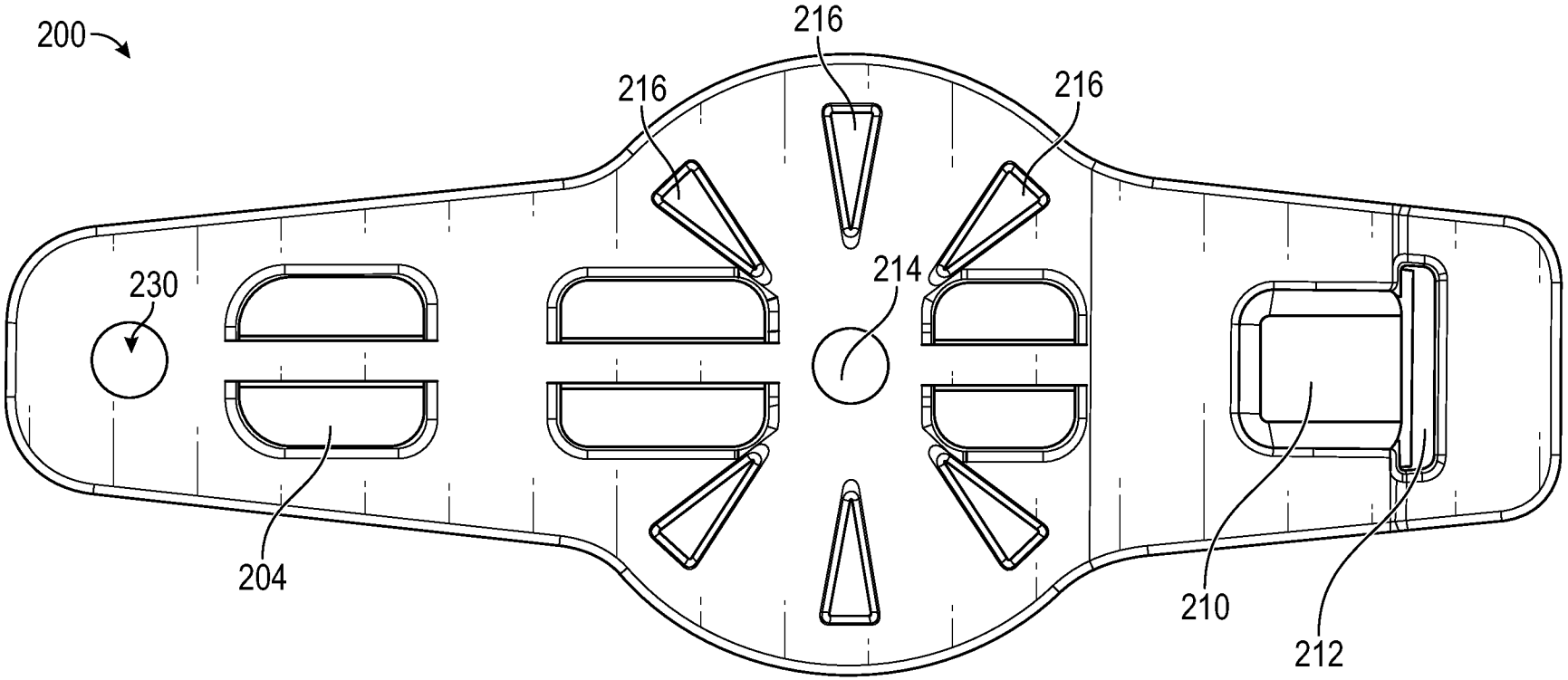
FIG. 6 is a rear view of an accessory mount in accordance with one or more embodiments of the disclosure.

FIG. 5 depicts an embodiment of the accessory mount 200. The accessory mount 200 has three sections, a center portion 250, a first wing 252, and a second wing 254. The accessory mount 200 is configured to be coupled to the universal mount 100 in a number of configurations or orientations as demonstrated in FIGS. 14*a*, 15*a*, 15*b*. The accessory mount 200 is also configured to have a holster 300 secured thereon. However, the accessory mount may be configured to have other accessories such as a magazine band, a combat knife or other weapon, or a tactical tool. The accessory mount 200 may have a t-slot 202 that slides into the holster cavity 302 to secure the holster 300 thereon. The accessory mount 200 may also have a hook 210 to secure onto holster offset 304 to lock the holster to the t-slot 202. Other mounting mechanisms and securing mechanisms are able to be used to secure the holster 300 to accessory mount 200 including, but not limited to, hook and loop fasteners, zip fasteners, snap and fit fasteners, and any other fastening method or mechanism suitable to firmly secure the holster to the accessory mount. Triangular protrusions 216 mate with the radially spaced channels 108 of the universal mount 100. The center portion 250 has a central hole 214 that may align with the central bore 112. The accessory mount 200 may be secured to the universal mount 100 by engaging the central bore with a t-nut, screw, pin, or other mechanical connection through the central hole 214. In such an embodiment, the central bore 112 may be configured to receive such t-nut, screw, pin, or other mechanical connection being threaded or having a pin-lock mechanism. In a further embodiment, the accessory mount 200 may connect directly to the pack 400 (or other mounting item) using a t-nut, screw, pin, or other mechanical connection through the central bore 112 and clamp the universal mount 100 between the pack 400 (or other mounting item) and the accessory mount.

Figure 7:
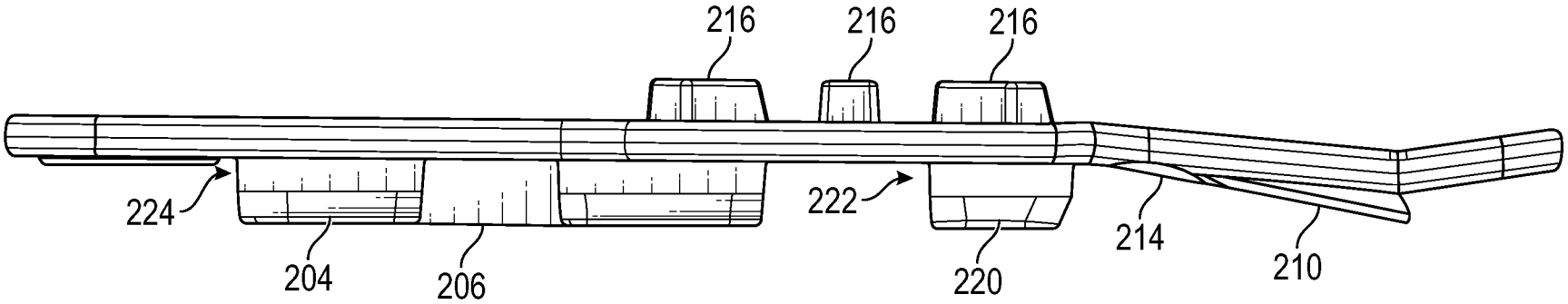
FIG. 7 is a top view of an accessory mount in accordance with one or more embodiments of the disclosure.
Figure 8:
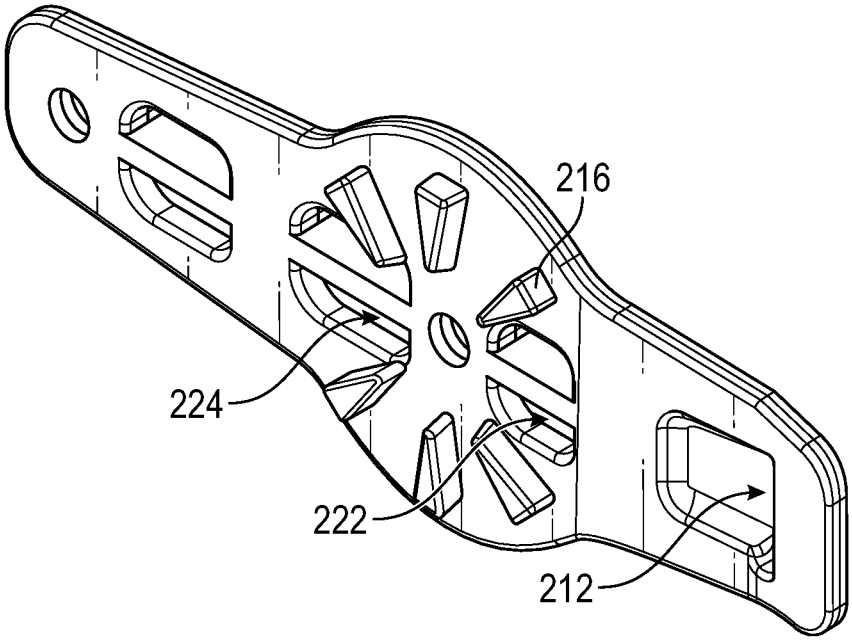
FIG. 8 is a rear-isometric view of an accessory mount in accordance with one or more embodiments of the disclosure.

In some embodiments, the first wing 252 may lie in the same plane as the central portion 250 and not the same plane as the second wing 254 as shown in FIG. 7. The first wing 252 may have the t-slot 202 and an aperture 230. The first wing may be aligned such that the first wing 252 and central portion 250 extend parallel to each other along an axis from the first wing 252 across the central portion 250 to the second wing 254.

In some embodiments, the aperture 230 may be disposed on the furthest edge of either the first wing 252 or the second wing 254. The aperture 230 may be used to secure a strap, rope, loop, or other mechanism therethrough. In a further embodiment, there may be an aperture disposed on the furthest edge of both the first wing 252 and the second wing 254 in order to increase the number of connections the accessory mount 200 has with the universal mount 100 in order to secure the accessory mount 200 more firmly.

In some embodiments, the t-slot 202 is disposed on the first wing 252, or extends from the first wing 252 to the central portion 250. The t-slot 202 may have thick portions 204 and thin portions 206 that allow for movement of the holster 300 or other tactical accessory, in some instances, only in the lateral direction. As shown in FIG. 7, the t-slot may be raised off the surface of the first wing 252 such that there is a space 224 such that the t-slot 202 may slide onto the holster cavity 302.

In some embodiments, the central portion 250 may lie in the same plane as the first wing 252 and not the same plane as the second wing 254. The central portion 250 of the accessory mount 200 may have the hole 214 and radially spaced protrusions 216 on one side, with the hole extending through the accessory mount. The central portion 250 may also have another t-slot 220 disposed thereon.

Figure 9:
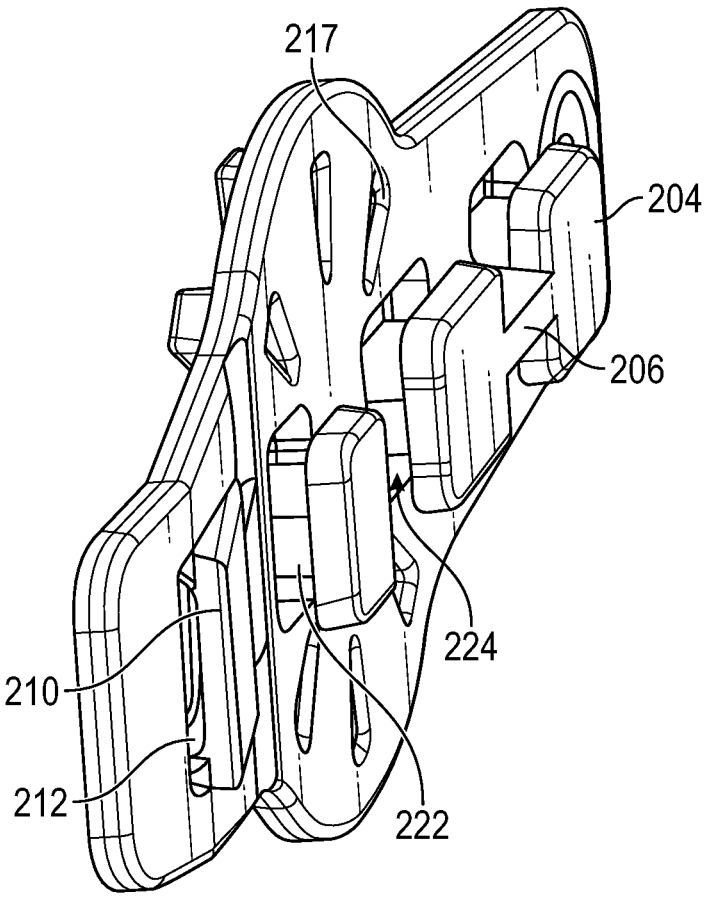
FIG. 9 is a front-isometric view of an accessory mount in accordance with one or more embodiments of the disclosure.

In some embodiments, the radially spaced protrusions 216 are spaced around a central hole 214 on the central portion 250 of the accessory mount 200. The radially spaced protrusions are configured in spacing, size, and shape to fit within the radially spaced channels 108 of the universal mount 100. There may be any number of radially spaced protrusions 216 up to and including the number of radially spaced channels 108. As shown in FIG. 5, there may be six (6) radially spaced triangular protrusions 216. As shown in FIG. 9, the protrusions 216 may have corresponding recesses 217 on the opposite surface of the central section.

In some embodiments, a t-slot 220 is disposed on the central portion 250. As shown in FIG. 7, the t-slot 220 may be raised off the surface of the central portion 250 such that there is a space 222 such that the t-slot 220 may slide onto a holster cavity (not shown).

In some embodiments as shown in FIG. 7, the second wing 254 may lie in a plane different than the central portion 250 and first wing 252. Since the second wing 254 is in a different plane than the central portion 250 and first wing 252, the holster offset 304 drops down and flexes the hook 210 disposed on the second wing 254 while the holster 300 is being slid laterally in a certain direction.

In some embodiments, the hook 210 may have an opening 212 configured to receive a holster offset 304. The holster offset 304 may fit within the opening 212 and flex into the open space below the opening 212. The hook 210 may further have an indention 214 in the second wing 254 to control the flexure. Once the holster 300 or other tactical accessory has slid a sufficient distance in the certain direction so that the holster offset 304 passes the hook 210 and falls into the opening 212. When the holster offset 304 falls into the opening 212, the hook 210 is no longer being flexed and returns to its resting position. While the holster offset 304 is in the opening 212 and while the hook 210 is in the resting position, the hook 210 engages the holster offset 304 securing the holster 300 to the accessory mount 200 such that the holster 300 cannot be slid in the opposite direction of the certain direction. Removing the holster 300 or other tactical accessory requires flexure of the hook 210 to disengage the hook 210 from the holster offset 304 while simultaneously sliding the holster 300 along the t-slot 202 in the opposite direction.

Figure 21B:
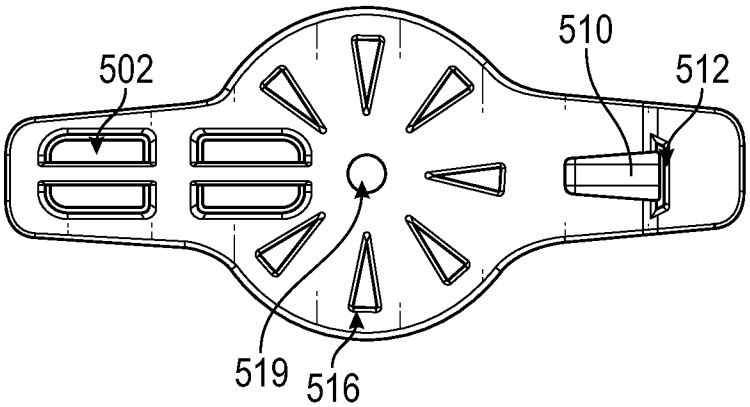
FIG. 21B is a rear view of an accessory mount in accordance with one or more embodiments of the disclosure.
Figure 21A:
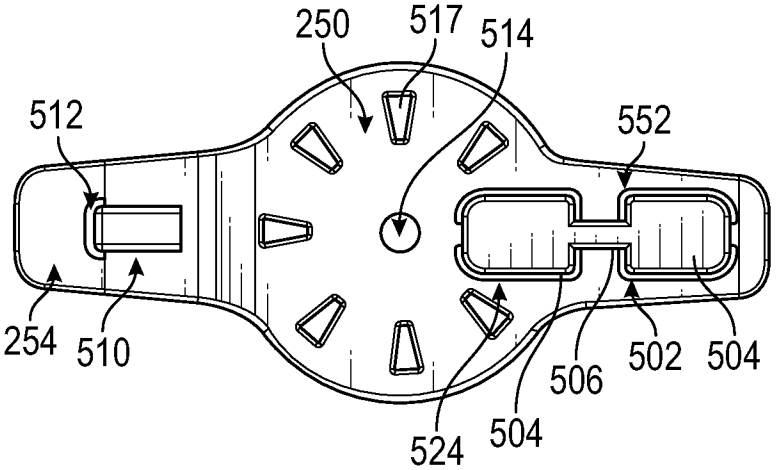
FIG. 21A is a front view of an accessory mount in accordance with one or more embodiments of the disclosure.
Figure 21C:
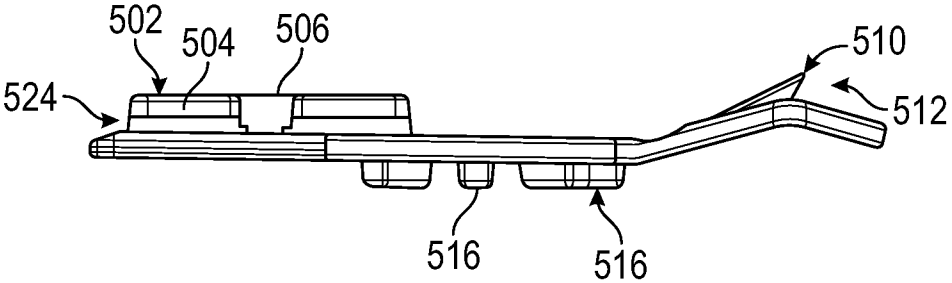
FIG. 21C is a top view of an accessory mount in accordance with one or more embodiments of the disclosure.

FIGS. 21*a*, 21*b*, and 21*c* depict an embodiment of the accessory mount 500. The accessory mount 500 has three sections, a center portion 550, a first wing 552, and a second wing 554. The accessory mount 500 is configured to be coupled to the universal mount 100 in a number of configurations or orientations as demonstrated in FIGS. 14*a*, 15*a*, 15*b*. The accessory mount 500 is also configured to have a holster 300 or other accessory such as a magazine band, a combat knife sheath, or another tactical tool secured thereon. The accessory mount 500 may have a t-slot 502 that slides into holster cavity 502 to secure the holster 500 thereon. The accessory mount 500 may also have a hook 510 to secure onto holster offset 504 to lock the holster to the t-slot 502. Triangular protrusions 516 mate with the radially spaced channels 108 of the universal mount 100. The center portion 550 has a central hole 514 that may align with the central bore 112 for securing the accessory mount to the universal mount using a t-nut, screw, pin, or other mechanical connection.

In some embodiments, the first wing 552 may lie in the same plane as the central portion 550 and not the same plane as the second wing 554. The first wing 552 may have the t-slot 502. The first wing 552 may be aligned such that the first wing 552 and center portion 550 extend parallel to each other along an axis from the first wing 552 across the central portion 550 to the second wing 554.

In some embodiments, the t-slot 502 is disposed on the first wing 552, or extends from the first wing 552 to the central portion 550. The t-slot 502 may have thick portions 504 and thin portions 506 that allow for movement of the holster, in some instances, only in the lateral direction. As shown in FIG. 7, the t-slot may be raised off the surface of the first wing 552 such that there is a space 524 such that the t-slot 502 may slide onto the holster cavity 302.

In some embodiments, the central portion 550 may lie in the same plane as the first wing 552 and not the same plane as the second wing 554. The central portion 550 of the accessory mount 500 may have the hole 514 and radially spaced protrusions 516 on one side, with the hole 514 extending through the accessory mount.

In some embodiments, the radially spaced protrusions 516 are spaced around a central hole 514 on the central portion 550 of the accessory mount 500. The radially spaced protrusions are configured in spacing, size, and shape to fit within the radially spaced channels 108 of the universal mount 100. There may be any number of radially spaced protrusions 516 up to and including the number of radially spaced channels 108. As shown in FIG. 21*b*, there may be seven (7) radially spaced triangular protrusions 516. As shown in FIG. 21*a*, the protrusions 516 may have corresponding recesses 517 on the opposite surface of the central section 550.

In some embodiments, the second wing 554 may lie in a plane different than the central portion 550 and first wing 552. Since the second wing 554 is in a different plane than the central portion 550 and first wing 552, the holster offset 504 drops down and flexes the hook 510 when the holster 300 is slid laterally in a certain direction. The second wing 554 may have a hook 510 disposed thereon.

In some embodiments, the hook 510 may have an opening 512 configured to receive an offset 504 of a holster or other accessory. The offset 504 may fit within the opening 512 and flex into the open space below the opening 512.

Figure 12:
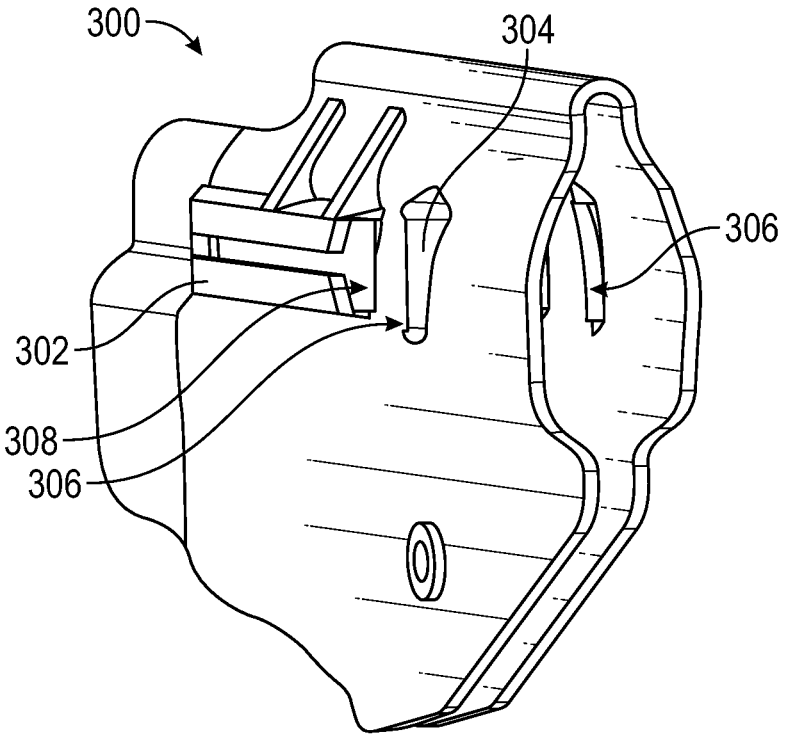
FIG. 12 is a perspective view of a holster in accordance with one or more embodiments of the disclosure.
Figure 13:
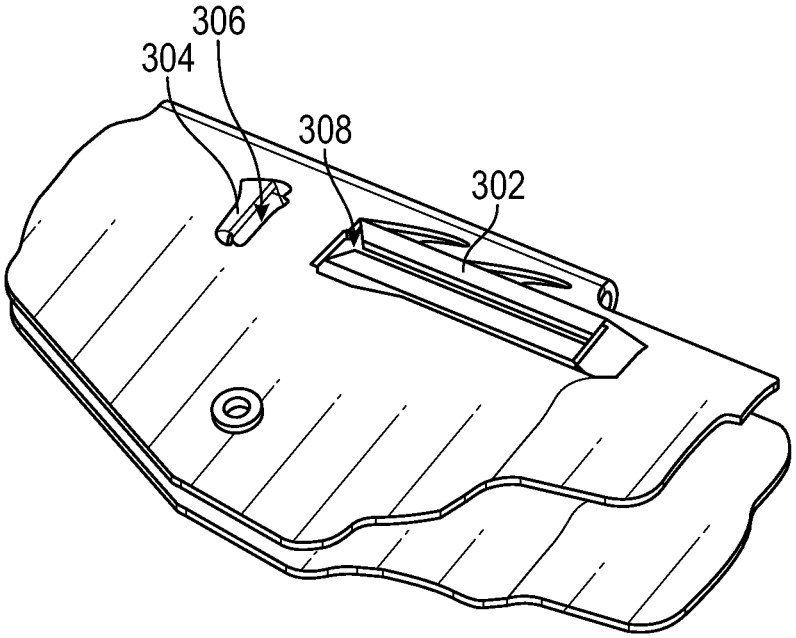
FIG. 13 is a bottom-up perspective view of a holster in accordance with one or more embodiments of the disclosure.

FIG. 12 depicts an embodiment of the holster 300, but it should be noted the features discussed herein may also be applied to other accessories such as a magazine band, a sheath for a combat knife, or another tactical tool. The holster 300 may have a holster cavity 302 and holster offset 304 disposed on the same surface of the holster. Further, the holster 300 may have a second holster cavity and a second holster offset disposed on a different surface of the holster. The placement of the second holster cavity and second holster offset allows for the holster or other tactical accessory to be attached in different directions without changing the radial orientation of the holster. For example, assume a right-handed user wishes to draw the firearm from the right side with the holster aligned so that it is parallel to the ground. Such a configuration would result in the firearm being holstered with the handle of the firearm pointing toward the ground. Now, if the same user is left handed, they may wish to draw the firearm from the left side. However, rotating the holster 180 degrees would result in the handle of the firearm pointing upward (i.e., the firearm is being drawn upside down). Therefore, the left-handed version of the user may wish to use the holster cavity and holster offset on the different surface of the holster without adjusting the radial orientation so that they may holster the firearm in such a way that the handle of the firearm is pointing toward the ground while still being able to draw the firearm from the left side.

Figure 17:
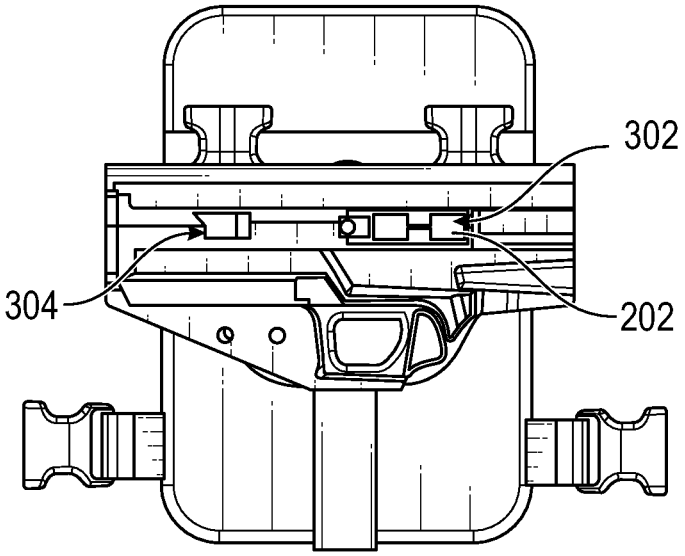
FIG. 17 is a front view of a universal mount system attached to an item in accordance with one or more embodiments of the disclosure.
Figure 18:
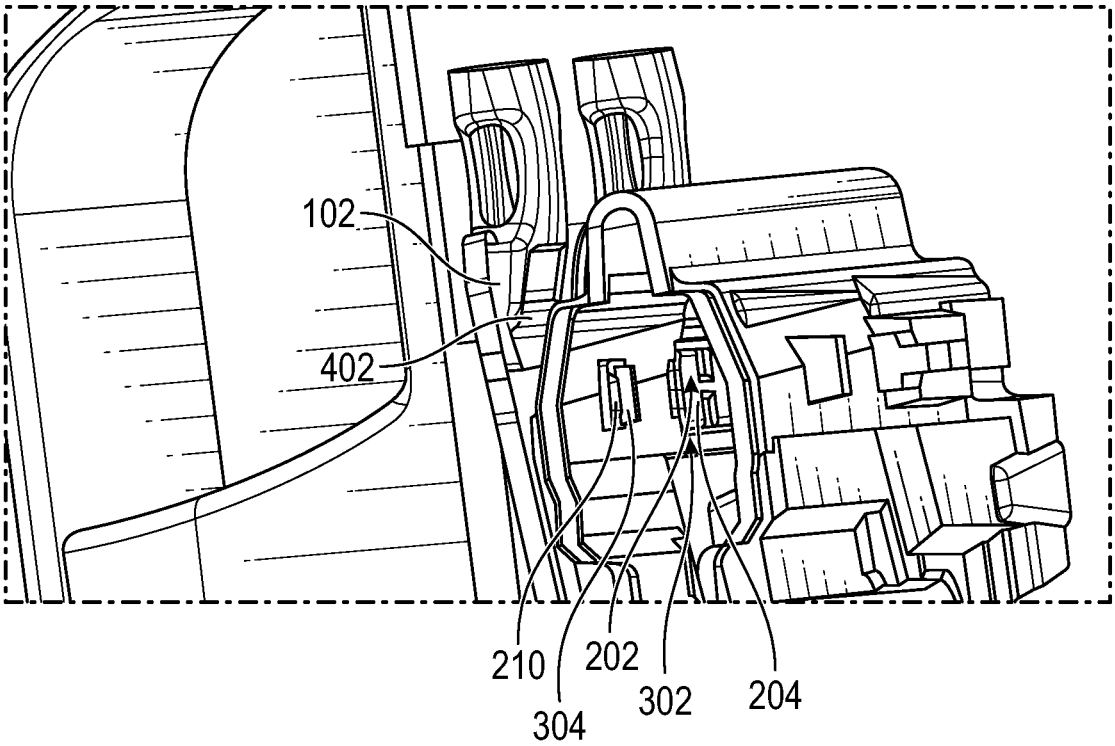
FIG. 18 is a perspective view of a universal mount system attached to an item in accordance with one or more embodiments of the disclosure.

In some embodiments, the holster cavity 302 is configured to slide upon the t-slot 202 by inserting the t-slot 202 through the opening 308 of the holster cavity. The holster 300 is then moved laterally, as depicted in FIG. 17, until the holster offset 304 drops into the opening 212 of the hook 210 and the holster 300 is secured to the accessory mount 200. Removing the holster 300 requires flexure of the second wing 254 to disengage the hook 210 from the holster offset 304 while simultaneously sliding the holster 300 along the t-slot 202 in the opposite direction. The holster may have a holster cavity and holster offset on different surfaces of the holster to allow the user to draw a firearm from the holster from either direction.

Figure 23:
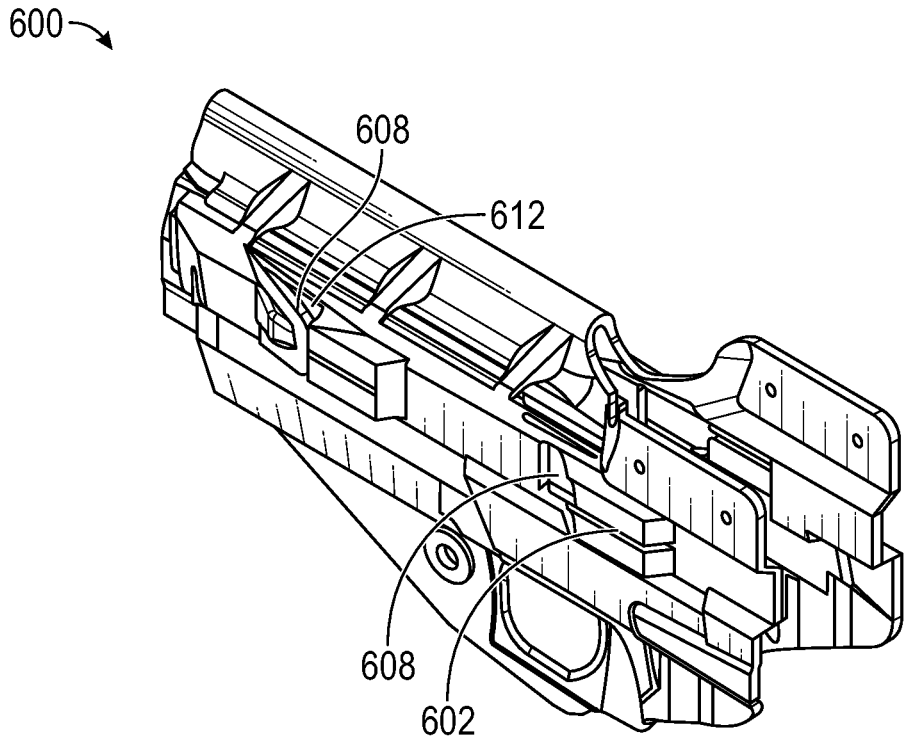
FIG. 23 is a perspective view of an accessory in accordance with one or more embodiments of the disclosure.

FIG. 23 depicts another embodiment of the holster 600, but it should be noted the features discussed herein may also be applied to other accessories such as a magazine band, a sheath for a combat knife, or another tactical tool. The holster 600 may have a holster cavity 602 and holster hook 610 disposed on the same surface of the holster. Further, the holster 600 may have a second holster cavity and a second holster hook disposed on a different surface of the holster.

Figure 24:
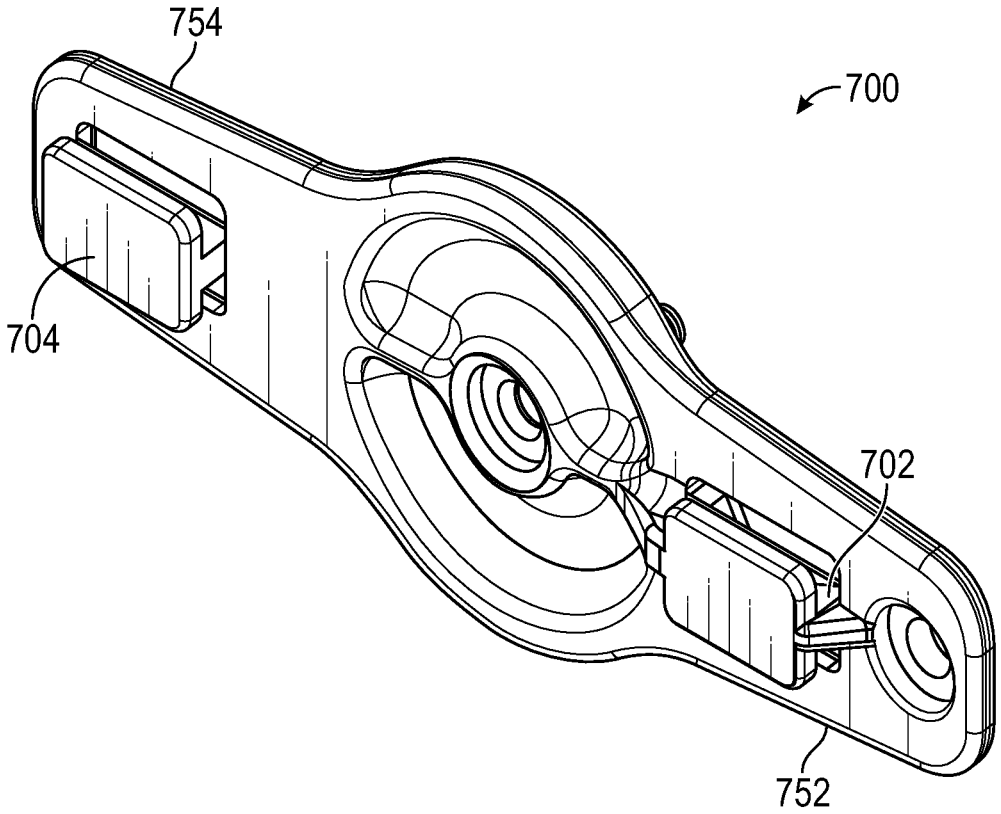
FIG. 24 is a perspective view of an accessory mount in accordance with one or more embodiments of the disclosure.
Figure 25:
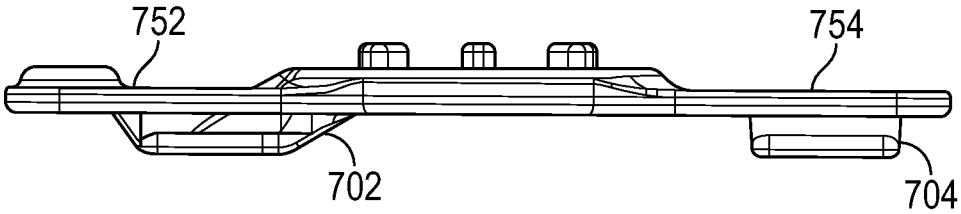
FIG. 25 is a top view of an accessory mount in accordance with one or more embodiments of the disclosure.

FIG. 24 and FIG. 25 depict yet another embodiment of the accessory mount 700. In such an embodiment, the first wing 752 has a t-slot disposed thereon. The second wing 754 has an offset 704 disposed thereon. The second wing 754 may also reside in the same plane as the first wing 752.

In some embodiments, the holster cavity 602 is configured to slide upon the t-slot 702 by inserting the t-slot 702 through the opening 608 of the holster cavity. The holster 600 is then moved laterally until the offset 704 drops into the opening 612 of the holster hook 610 and the holster 600 is secured to the accessory mount 700. Removing the holster 600 requires flexure of the holster hook 610 to disengage the holster hook 610 from the offset 704 while simultaneously sliding the holster 600 along the t-slot 702 in the opposite direction. The holster may have a holster cavity and holster hook on different surfaces of the holster to allow the user to draw a firearm from the holster from either direction.

FIGS. 14*a* and 14*b* depict an embodiment of a pack 400. The pack 400 may have straps 402 along the top and other types of straps on the bottom 404. These straps 402, 404 are configured to wrap around or through the hooks 102 and apertures 106, 116 in order to secure the universal mount 100 against the pack 400.

Figure 22:
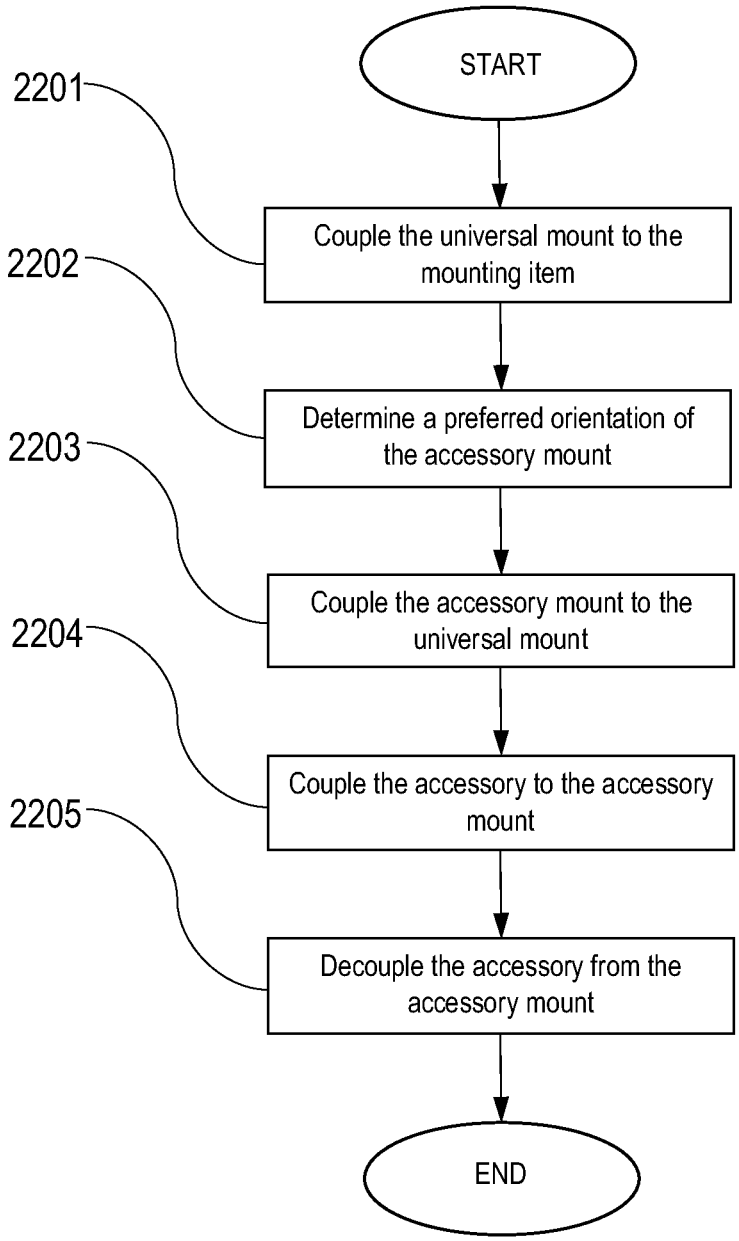
FIG. 22 is a flowchart of a method to use the universal mount system in accordance with one or more embodiments of the disclosure.

FIG. 22 is a flowchart of a method to mount the universal mounting system and position the accessory in the preferred orientation in accordance with one or more embodiments. Initially, at block 2201, the universal mount is coupled to the mounting item by engaging the wings with a securing mechanism of the mounting item and/or threading straps or ropes of the mounting item through the apertures of the universal mount's frame. At block 2202, a preferred orientation of the accessory mount is determined by the user, wherein the preferred orientation of the accessory mount is one where, when the accessory is attached to the accessory mount, the accessory is most easily accessed by the user. At block 2203, the accessory mount is coupled to the universal mount by first aligning and then inserting the protrusions of the accessory mount to the channels of the universal mount in such a way that the accessory mount is in the preferred orientation, and then using a bolt, screw, pin, or other suitable fastener through the central hole of the accessory mount to the central bore of the universal mount. At block 2204, the accessory is coupled to the accessory mount by first inserting the t-slot of the accessory mount to the cavity, such as a holster cavity, in the accessory, and then sliding the accessory along the t-slot until the hook of the accessory mount engages the offset of the accessory. At block 2205, the accessory is removed from the accessory mount by flexing the hook of the accessory mount in order to disengage it from the offset of the accessory, and then sliding the accessory off of the accessory mount.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

Those having ordinary skill in the art will recognize that numerous modifications can be made to the specific implementations described above. The implementations should not be limited to the particular limitations described. Other implementations may be possible.

That which is claimed is:

1. A universal mount system comprising:

a universal mount;

an accessory mount configured to be coupled to the universal mount, wherein the accessory mount is configured to be coupled in multiple orientations; and an accessory coupled to the accessory mount, wherein the universal mount comprises a wheel mechanism comprising channels radially spaced around a central bore, wherein the accessory mount comprises protrusions radially spaced around a central hole, wherein the universal mount is configured to be coupled to the accessory mount in multiple orientations by securing a fastener through the central hole and the central bore when the protrusions are inserted into the channels, wherein the accessory comprises a cavity disposed on a first surface of the accessory, and wherein the accessory mount comprises a t-slot configured to couple with the cavity.

2. The universal mount system of claim 1, wherein the universal mount further comprises:

a frame; and at least one wing coupled to the frame, wherein the at least one wing is in a different plane than the frame, and wherein the at least one wing is configured to couple to at least one securing mechanism of a mounting item.

3. The universal mount system of claim 2, wherein the universal mount further comprises apertures disposed on the frame that are configured to couple to straps, loops, and/or ties of the mounting item.

4. The universal mount system of claim 1, further comprising a mounting item coupled to the universal mount.

5. The universal mount system of claim 1, wherein the channels radially spaced around a central bore are at least sixteen (16) channels radially spaced around a central bore, and wherein the channels are separated by 22.5 degrees.

6. The universal mount system of claim 1, wherein the accessory mount is a holster mount, and wherein the accessory is a holster.

7. The universal mount system of claim 1, wherein the accessory further comprises a second cavity disposed on a second surface of the accessory, wherein the second cavity is configured to couple to the t-slot.

8. The universal mount system of claim 1, wherein the universal mount further comprises:

a frame; and at least one wing coupled to the frame, wherein the at least one wing is in a different plane than the frame, and wherein the at least one wing is configured to couple to at least one securing mechanism of a mounting item.

9. The universal mount system of claim 8, wherein the universal mount further comprises apertures disposed on the frame that are configured to couple to straps, loops, and/or ties of the mounting item.

10. A universal mount system comprising:

a universal mount;

an accessory mount configured to be coupled to the universal mount, wherein the accessory mount is configured to be coupled in multiple orientations; and an accessory coupled to the accessory mount, wherein the accessory mount comprises:

a central portion comprising protrusions radially spaced around a central hole;

a first wing extending from the central portion comprising a t-slot; and a second wing extending from the central portion comprising a hook, and wherein the accessory comprises:

a cavity disposed on a first surface of the accessory; and an offset disposed on the first surface of the accessory, wherein the cavity is configured to couple with the t-slot, and wherein the offset is configured to couple with the hook.

11. The universal mount system of claim 10, wherein the universal mount further comprises:

a frame; and at least one wing coupled to the frame, wherein the at least one wing is in a different plane than the frame, and wherein the at least one wing is configured to couple to at least one securing mechanism of a mounting item.

12. The universal mount system of claim 11, wherein the universal mount further comprises apertures disposed on the frame that are configured to couple to straps, loops, and/or ties of the mounting item.

13. The universal mount system of claim 10, wherein the accessory mount further comprises a second t-slot disposed on the central portion.

14. The universal mount system of claim 10, further comprising a mounting item coupled to the universal mount.

15. The universal mount system of claim 10, wherein the accessory mount is a holster mount, and wherein the accessory is a holster.

16. The universal mount system of claim 10, wherein the t-slot extends from the first wing to the central portion.

17. A universal mount system comprising:

a universal mount;

an accessory mount configured to be coupled to the universal mount, wherein the accessory mount is configured to be coupled in multiple orientations; and an accessory coupled to the accessory mount, wherein the accessory mount comprises:

a central portion comprising protrusions radially spaced around a central hole;

a first wing extending from the central portion comprising a t-slot; and a second wing extending from the central portion comprising an offset, and wherein the accessory comprises:

a cavity disposed on a first surface of the accessory; and a hook disposed on the first surface of the accessory, wherein the cavity is configured to couple with the t-slot, and wherein the hook is configured to couple with the offset.

18. The universal mount system of claim 17, further comprising a mounting item coupled to the universal mount.

19. The universal mount system of claim 17, wherein the accessory mount is a holster mount, and wherein the accessory is a holster.

20. The universal mount system of claim 17, wherein the accessory further comprises a second hook disposed on a second surface of the accessory, wherein the second hook is configured to couple with the offset.

* * * * *